US005088843A

United States Patent [19]

Hori

[11] Patent Number: 5,088,843

[45] Date of Patent: Feb. 18, 1992

[54] PRINTER CAPABLE OF CORRECTING DISTANCE BETWEEN PRINT HEAD AND PRINT PAPER AFTER LID IS OPENED

[75] Inventor: Masaaki Hori, Nagoya, Japan

[73] Assignee: Brother Kogyo Kabushiki Kaisha, Nagoya, Japan

[21] Appl. No.: 393,634

[22] Filed: Aug. 14, 1989

[30] Foreign Application Priority Data

Aug. 16, 1988 [JP] Japan ..... 63-203357

[51] Int. Cl.[5] ..... B41J 25/308

[52] U.S. Cl. ..... 400/59; 400/690.4

[58] Field of Search ..... 400/55–59, 400/624, 690.4

[56] References Cited

U.S. PATENT DOCUMENTS

| | | | |
|---|---|---|---|
| 4,268,177 | 5/1981 | Veale | 400/55 |
| 4,389,129 | 6/1983 | Sugiura | 400/54 |
| 4,652,153 | 3/1987 | Kotsuzumi | 400/59 |
| 4,676,675 | 6/1987 | Suzuki | 400/56 |
| 4,759,648 | 7/1988 | Kobayashi et al. | 400/568 |
| 4,789,258 | 12/1988 | Gomoll et al. | 400/605 |
| 4,808,019 | 2/1989 | Olson | 400/624 |
| 4,881,835 | 11/1989 | Niikawa | 400/56 |

FOREIGN PATENT DOCUMENTS

| | | | |
|---|---|---|---|
| 0235633 | 7/1988 | European Pat. Off. | 400/605 |
| 711181 | 6/1981 | Japan | 400/55 |
| 124881 | 7/1984 | Japan | 400/322 |
| 61-25874 | 2/1986 | Japan | 400/624 |
| 123561 | 6/1986 | Japan | 400/55 |

*Primary Examiner*—David A. Wiecking
*Assistant Examiner*—Steven S. Kelley
*Attorney, Agent, or Firm*—Oliff & Berridge

[57] ABSTRACT

After a printer lid has been opened, when a signal indicating that the lid is closed again and a signal indicating that there is a sheet in a print mechanism are received, the spacing or distance between a print head and the face of a sheet held against a platen is automatically adjusted to a desired value. Therefore, when a printing process is to be resumed after the lid has been opened during printing operation, the spacing between the print head and the face of the sheet is corrected even if the spacing may have been varied due to physical contact to the print head or the carriage mounting the print head by the operator, so that desired print quality will be maintained after the printing process is resumed.

13 Claims, 5 Drawing Sheets

PRINTER CAPABLE OF CORRECTING DISTANCE BETWEEN PRINT HEAD AND PRINT PAPER AFTER LID IS OPENED

BACKGROUND OF THE INVENTION

The present invention relates to a printer having a lid for covering a print head and a platen confronting the print head, in which the lid is openably hinged to a printer housing. More particularly, the invention relates to such a printer having a means for controlling printer operation when a printing process is to be resumed after the lid has been opened.

Printers generally include a lid for covering a print mechanism including a print head and a platen, in which the lid is openably hinged to a printer housing. The printer lid is not normally opened during printing operation, however, it needs to be opened when a paper jam has occurred or an ink ribbon is to be replaced. Since the uncovered print mechanism is dangerous to the operator, conventional printers have a mechanism for interrupting the printing operation when the lid is opened during operation. When removing the jammed paper or replacing the ink ribbon, the print head and its carriage may be touched and moved by the operator. The conventional printers have a mechanism for correcting the position of the carriage before the printing process is resumed after the lid has been opened.

However, such conventional printers have the following disadvantage. To resume the printing process, the lid is closed, and an on-line/off-line selector key is pressed to select an on-line mode. Even if the carriage or surrounding parts are touched by the operator during printer shutdown, the print position can be corrected since the carriage can be positionally corrected as described above. However, if the spacing between the print head and the sheet of print paper set on the platen is varied due to the touch to the carriage by the operator, then the quality of the printed letters may be lowered since such spacing is not corrected in the conventional printers.

Accordingly, the conventional printers may cause printing irregularity once the lid is opened during printer operation.

SUMMARY OF THE INVENTION

In view of the aforesaid problem of the conventional printers, it is an object of the present invention to provide a printer capable of maintaining stable print quality even when the lid of the printer is opened during printer operation.

According to the present invention, there is provided a printer comprising a printer housing, a print mechanism housed in the printer housing, the print mechanism including a print head and a platen, the print head being disposed in spaced apart relation from a sheet of print paper set on the platen and performing printing operation on the sheet of print paper set thereon, the platen being rotatably supported to the printer housing, and the sheet of print paper having a thickness, a lid member openably attached to the printer housing for normally covering the print mechanism, lid open/closure detecting means for detecting opening and closing of the lid member and producing a first signal when the lid member is opened and a second signal when the lid member is closed, distance adjusting means for adjusting a distance between the sheet of print paper set on the platen and the print head, and control means for controlling the distance adjusting means when the second signal is produced subsequent to the production of the first signal.

The printer may further include the following either solely or in combination.

(1) Sheet detecting means for detecting presence of the sheet of print paper on the platen and producing a third signal when the sheet of print paper is present on the platen and a fourth signal when the sheet of print paper is absent from the platen, wherein the control means controls the distance adjusting means provided that the third signal has been produced when the second signal is produced subsequent to the first signal.

(2) Sheet supplying means for selectively supplying different types of sheets into a gap between the print head and the platen, the different types of sheets having different sheet thicknesses, and sheet specifying means for specifying one of the different types of sheets, the sheet specifying means producing a sheet specifying signal indicative of the sheet specified;

(3) Storage means for storing data regarding the distance therebetween corresponding to the sheet thickness of each of the sheets supplied from the sheet supplying means, wherein the control means controls the distance therebetween upon reading the data output from the storing means in response to the sheet specifying signal.

The distance adjusting means brings the print head into abutment against the platen and then retracts the print head away from the platen to adjust the distance therebetween.

The print mechanism further includes a carriage for mounting the print head, and a pair of guide rods supported to the print housing and disposed in parallel to the platen for supporting the carriage so that the carriage is longitudinally reciprocally movable along the pair of guide rods, wherein the distance adjusting means comprises a pair of shafts connected to end faces of one of the pair of guide rods in offset relation, gear means operably coupled to one of the pair of shafts, a reversible motor for rotating the pair of shafts through the gear means, whereby the print head is moved toward and away from the platen by the forward and reverse rotations of the motor, respectively.

In accordance with the present invention, when the lid member is closed after it has been opened and the printing process is to be resumed, the spacing or distance between the print head and the face of the sheet of print paper set on the platen is adjusted so as to correspond to the thickness of the sheet of print paper. Therefore, even if the distance between the print head and the face of the sheet were varied due to physical contact to the carriage or the print head by the operator while the lid is open, the spacing is automatically corrected and the quality of the printed letters will not be lowered after the printing process is resumed. When the lid is opened and then closed, the operator is not required to adjust the spacing between the print head and the platen, and good and stable print quality is maintained.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

Figure 1:
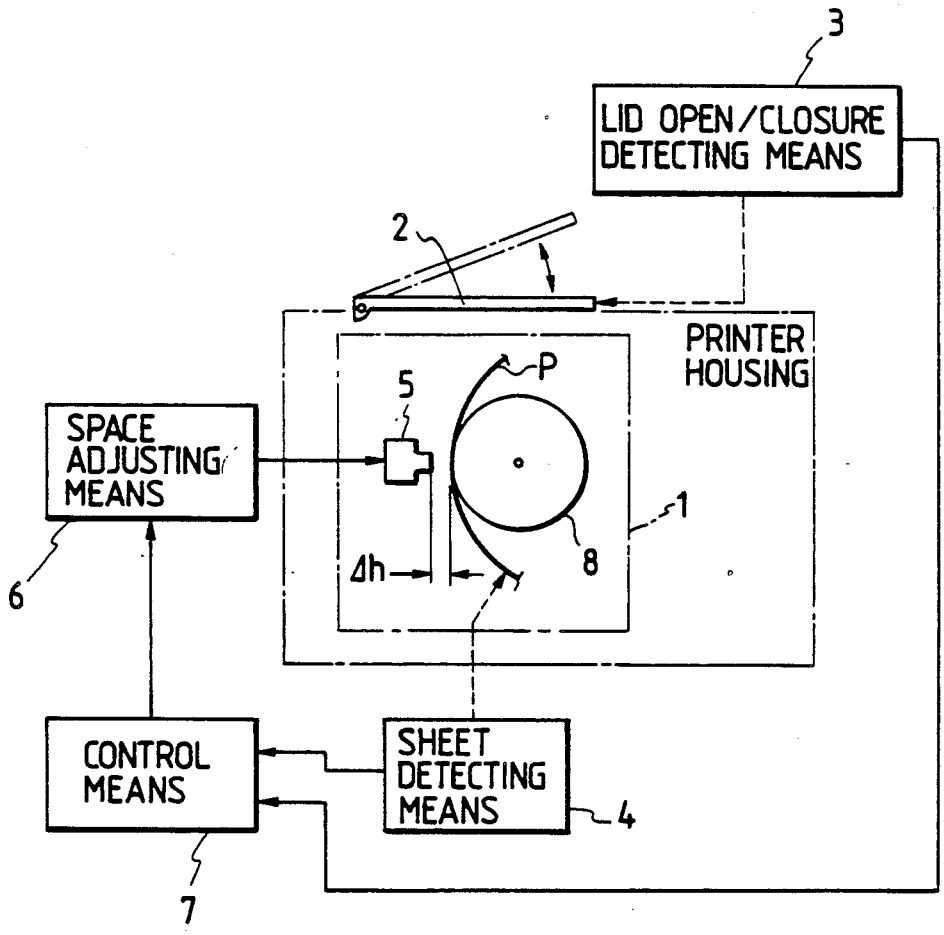
FIG. 1 is a block diagram of a printer according to the present invention.

As shown in FIG. 1, a printer according to the present invention includes a lid open/closure detecting means 3 for determining whether a lid 2 which normally covers a print mechanism 1 is opened or not, a sheet detecting means 4 for determining whether there is a sheet P in the print mechanism 1, a space adjusting means 6 for adjusting the spacing Δh between the face of the sheet P supplied between a platen 8 and a print head 5, and a control means 7 for controlling operation of the space adjusting means 6 to adjust the spacing Δh in response to a signal received from the lid open/closure detecting means 3 and indicating that the lid 2 is closed and also to a signal received from the sheet detecting means 4 and indicating that there is a sheet in the print mechanism 1, after having received a signal from the lid open/closure detecting means 3 indicating that the lid 2 is opened.

After the lid 2 has been opened, when a signal issued by the lid open/closure detecting means 3 indicating that the lid 2 is closed and a signal issued by the sheet detecting means 4 indicating that there is a sheet in the print mechanism 1 are received by the control means 7, the control means 7 controls the operation of the space adjusting means 6 to adjust the spacing or distance Δh between the print head 5 and the face of the sheet P.

Therefore, when the printing process is to be resumed after the lid 2 has been opened during printing operation, the spacing Δh between the print head 5 and the face of the sheet P is automatically adjusted corresponding to the thickness of the sheet P so that desired print quality will be maintained even after the printing process is resumed.

Figure 2:
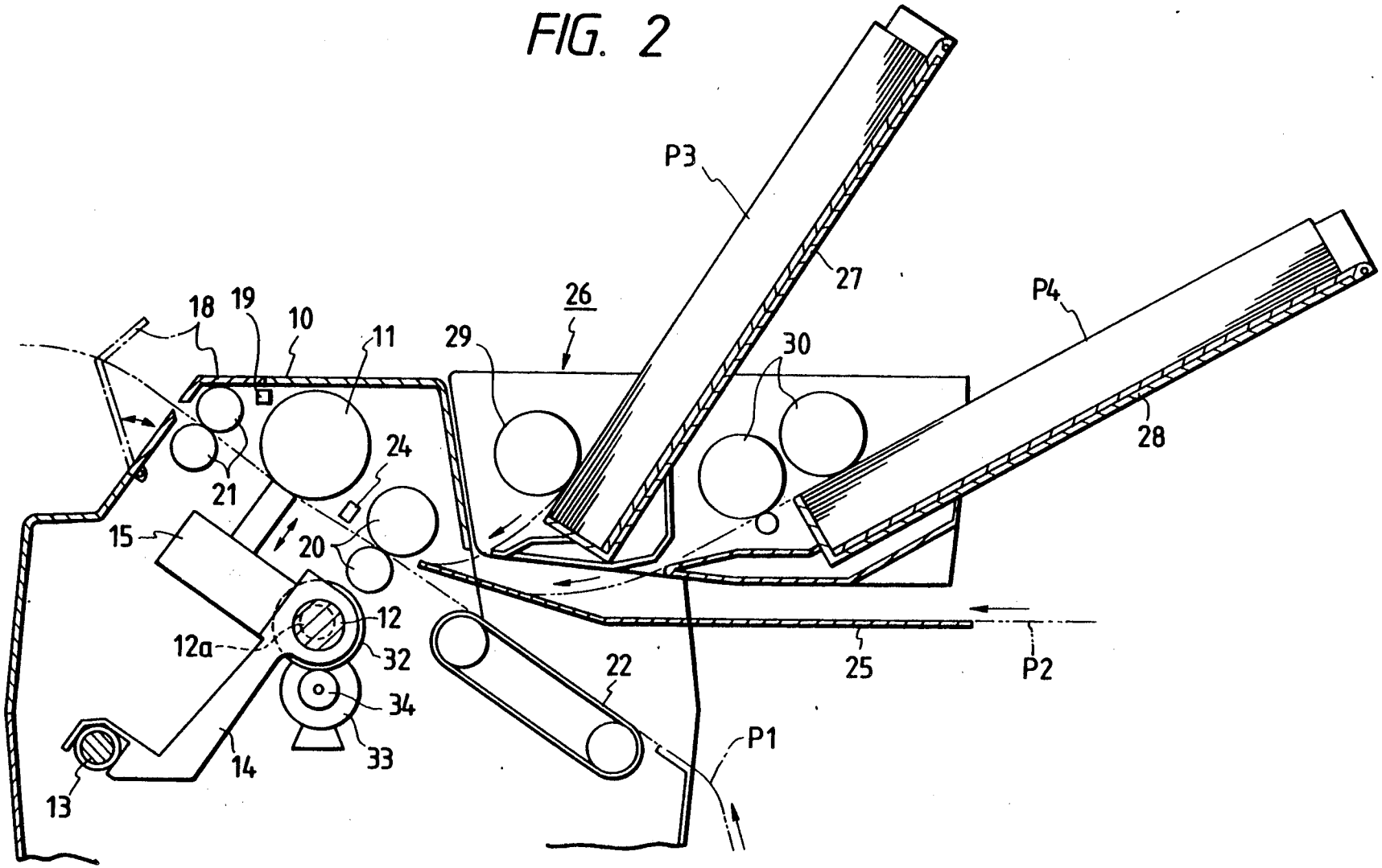
FIG. 2 is a fragmentary vertical cross-sectional view of a print mechanism in the printer.
Figure 3:
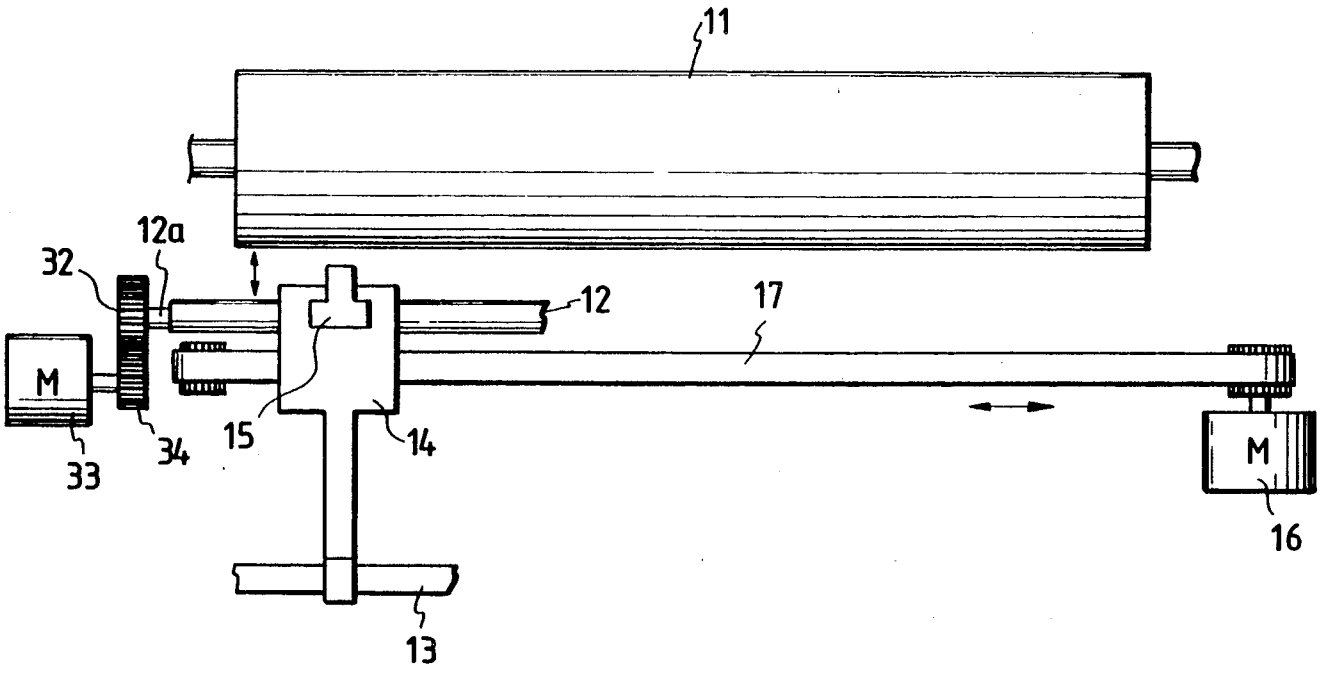
FIG. 3 is a plan view of the print mechanism.

The printer will be described in greater detail with reference to FIGS. 2 and 3.

The printer has a printer housing 10 in which a platen 11 is rotatably supported. Two guide rods 12, 13 are disposed in parallel to the platen 11 and supported in the printer housing 10. The guide rod 12 is positioned directly below the platen 11, whereas the guide rod 13 is positioned below and forwardly of the platen 11. The guide rods 12, 13 support a carriage 14 so that the carriage 14 is movable longitudinally along the guide rods 12, 13. A print head 15 (corresponding to the print head 5 in FIG. 1) is mounted on the carriage 14 in confronting relation to the platen 11. The print head 15 is movable with the carriage 14 reciprocally along the guide rods 12, 13 when the carriage 14 is driven by a motor 16 through a belt 17 connected to the carriage 14.

A lid 18 (corresponding to the lid 2 in FIG. 1) is openably attached to an upper portion of the printer housing 10 for covering the printer mechanism which includes the print head 15 and the platen 11. A first microswitch 19 (corresponding to the lid open/closure detecting means 3 in FIG. 1) is mounted on the printer housing 10 near the free end of the lid 18 for detecting whether the lid 18 is opened or closed.

A pair of feed rollers 20 and another pair of feed rollers 21 are disposed on each side of the platen 11 for feeding a sheet of print paper into the gap between the print head 15 and the platen 11. A pin tractor 22 is located upstream of the feed rollers 20 with respect to the direction in which the sheet is fed. A continuous sheet P1 such as a labeled sheet or the like is fed by the pin tractor 22 into the printing area in the gap between the print head 15 and the platen 11. The feed rollers 20, 21 and the pin tractor 22 are coupled to a single sheet feed motor 23 shown in FIG. 4 and hence can be rotated thereby. A second microswitch 24 (corresponding to the sheet detecting means 4 in FIG. 1) for detecting whether there is a sheet between the print head 15 and the platen 11 is disposed near the feed rollers 20 and closely to the platen 11.

A manual sheet feed guide plate 25 is substantially horizontally supported in the printer 10 above the pin tractor 22 and partly projects out of the printer housing 10. A single sheet P2 such as a sheet of a particular size or an envelope, for example, can be manually fed over the guide plate 25 toward the rollers 20. An ACSF (automatic cut sheet feeder) unit 26 for automatically feeding sheets is detachably mounted on the printer housing 10 above the guide plate 25. The ACSF unit 26 has a pair of stackers or trays 27, 28 which store stacks of sheets P3, P4 such as cut sheets, envelopes, or the like, and feed rollers 29, 30 for feeding the uppermost sheets P3, P4 one at a time from the cassettes 27, 28. The feed rollers 29, 30 are coupled to a reversible feed motor 31 (see FIG. 4) through a selector means (not shown) and hence are rotatable thereby.

The guide bar 12 has a pair of eccentric shafts 12*a* on its opposite ends, and the shafts 12*a* are rotatably supported on opposite side panels of the printer housing 10. One of the eccentric shafts 12*a* supports a gear 32 through a slip clutch (not shown), the gear 32 meshing with a gear 34 fixedly mounted on the shaft of a space adjusting motor 33. When the gear 34 is rotated clockwise (FIG. 2) about its own axis by the motor 33, the eccentric shaft 12*a* is rotated counterclockwise through the gear 32 and the slip clutch. Then, the central axis of the guide rod 12 is displaced to move the carriage 14 and the print head 15 mounted thereon toward the platen 11. When the motor 33 is reversed, the print head 15 is moved away from the platen 11. The motor 33, the eccentric shaft 12*a* of the guide bar 12, and the gears 32, 34 serve as the space adjusting means 6 shown in FIG. 1. The spacing between the platen 11 and the print head 15 may be varied, for example, by moving the print head 15 toward the face of the sheet until the tip of the print head 15 abuts against the face of the sheet, and then moving the print head 15 a fixed distance away from the face of the sheet so that the spacing Δh between the tip of the print head 15 and the face of the sheet will be adjusted to a fixed distance.

The spacing Δh is adjusted when the printing process is to be resumed after the lid 18 has been opened during printer operation. The spacing Δh will be adjusted as follows.

Figure 4:
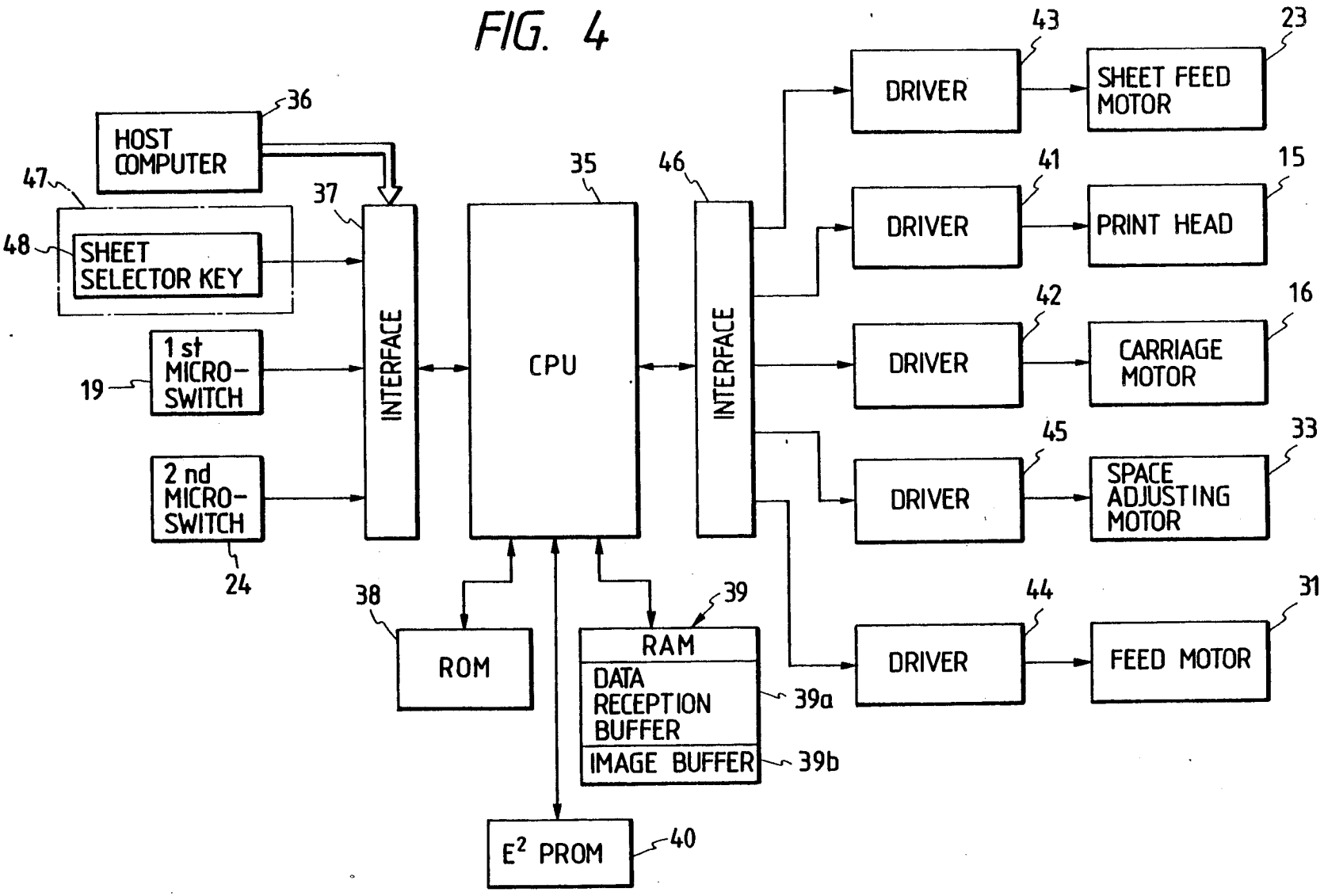
FIG. 4 is a detailed block diagram of the printer.

FIG. 4 is a block diagram of the printer which includes a printer control central processing unit (CPU) 35 which corresponds to the control means 7 in FIG. 1.

To the printer control CPU 35, there are connected through an interface 37 a host computer 36, the first microswitch 19 for detecting whether the lid 18 is opened or not, the second microswitch 24 for detecting whether there is a sheet between the platen 11 and the print head, i.e., in the print mechanism, and at least a sheet selector key 48 among various control keys on a control panel 47. The printer control CPU 35 is also connected to a ROM 38 storing a program for controlling the entire operation of the printer and a program for controlling an operation sequence shown in FIG. 5, a RAM 39 for temporarily storing print data from the host computer 35, and a non-volatile electrically erasable programmable read-only memory ($E^2$PROM) 40 for storing predetermined spacing data and optimum spacing position data for respective sheet types used. To the printer control CPU 35, there are also coupled through an interface 46 the print head 15, the carriage motor 16, the sheet feed motor 23, the feed motor 31, the space adjusting motor 33, and their associated drivers 41 through 45.

The sheet selector key 48 is used to select a manual feed mode in which a sheet supplied over the manual sheet feed guide plate 25 is used, a continuous feed mode in which a continuous sheet supplied by the pin tractor 22 is used, an ACSF(I) mode in which a sheet stored in the cassette 27 of the ACSF unit 26 is used, and an ACSF(II) mode in which a sheet in the other cassette 28 of the ACSF(II) unit 26 is used. The RAM 39 has a data reception buffer **39*a* for receiving several lines or pages of print data transmitted from the host computer 36, and an image buffer 39*b* for storing image data, as dot data, of one line of print data stored in the data reception buffer 39*a***.

Figure 5:
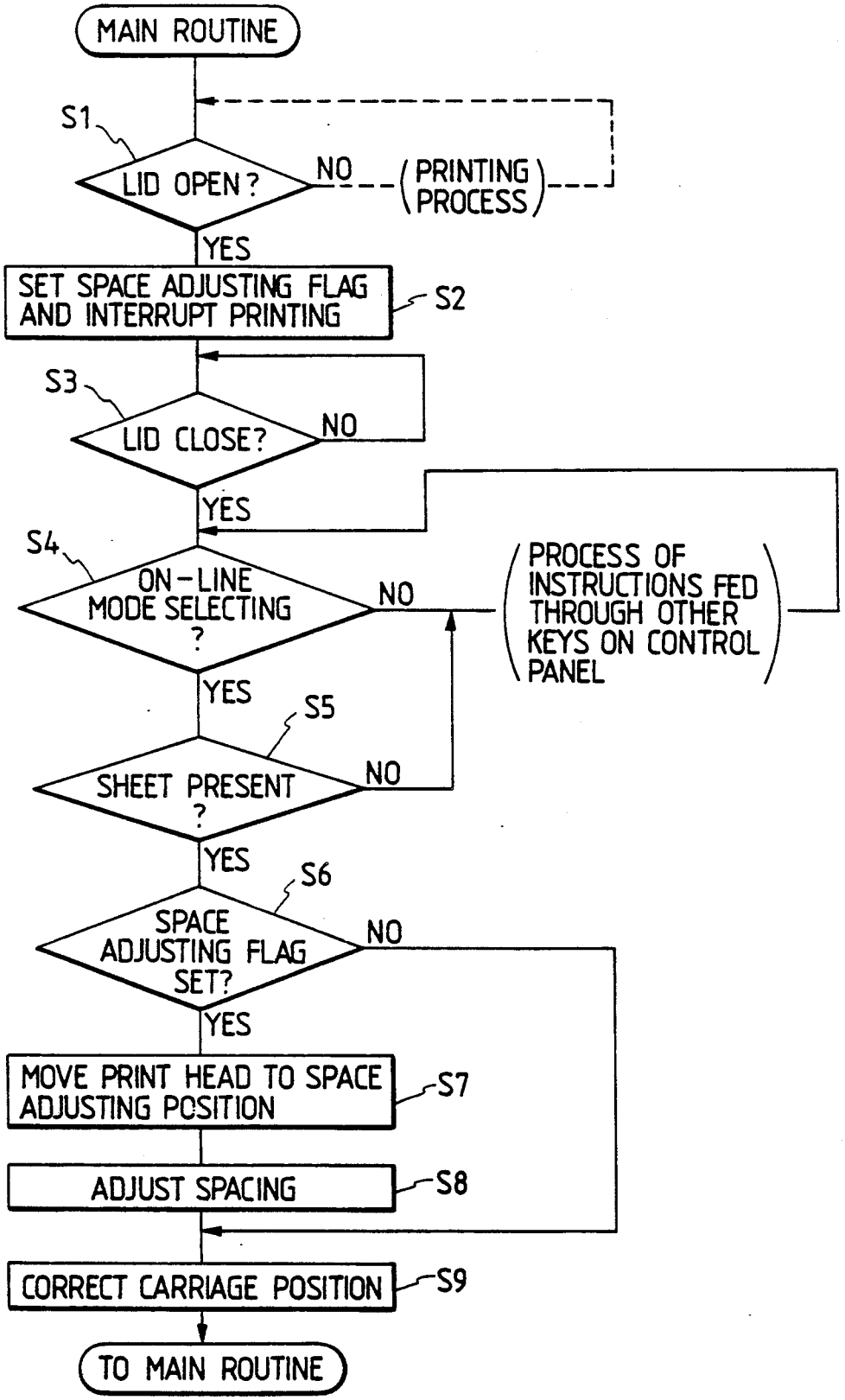
FIG. 5 is a flowchart of an operation sequence of the printer.

Operation of the printer thus constructed will be described with reference to the flowchart of FIG. 5.

Any one of the sheets P1 through P4 is introduced into the gap between the platen 11 and the print head 15, and the image data stored in the image buffer **39*b*** are printed on the sheet according to a predetermined printing process. The printing process is of a known nature, and will not be described in detail.

While the printing process is in progress, it is checked in step S1 whether the lid 18 is open or not based on an output signal from the first microswitch 19. If the lid 18 is not open, then control proceeds to a routine for the printing process. If the lid 18 is open, then control goes to steps S2 through S9.

In step S2, a space adjusting flag which indicates adjustment of the spacing Δh between the print head 15 and the face of the sheet on the platen 11 is set, an off-line mode is selected to stop data transmission from the host computer 36, and the printing process is interrupted after the image data stored in the image buffer **39*b* have been printed. It is checked in step S3 whether the lid 18 is closed or not based on an output signal from the first microswitch 19. If the lid 18 is not closed, then the processing in step S3 is repeated until the lid 18 is closed. If the lid 18 is closed, then it is checked in step S4 whether an on-line mode is selected or not. The on-line mode is selected when the operator manipulates an on-line/off-line mode selector key (not shown) on the control panel 47**.

If the on-line mode is not selected, then control enters a loop in which a process instructed by other keys on the control panel 47 is executed, until the on-line mode is selected. If the on-line mode is selected, then it is checked in step S5 whether there is a sheet between the platen 11 and the print head 15 based on an output signal from the second microswitch 24. If there is no sheet, then the processing goes into the loop in which a process instructed by other keys on the control panel 27 is executed, until a sheet is detected by the second microswitch 24. If there is a sheet between the platen 11 and the print head 15, then it is checked in step S6 whether the space adjusting flag has been set or not. If the flag has been set, then the processings in steps 7 and 8 are executed, and if the flag has not been set, then the processings in steps 7 and 8 are skipped and the processing in step 9 is directly executed.

The step S7 first recognizes which sheet type is being used based on the sheet mode selected by the sheet selector key 48. Spacing adjusting position data optimum for the sheet type being used are then read out of the $E^2$PROM 40, and the carriage 14 and the print head 15 are moved to the position represented by the spacing adjusting position data thus read. Then, in step S8, the predetermined spacing data are read out of the $E^2$PROM 40, and the spacing or distance Δh between the print head 15 and the face of the sheet is adjusted to the value of the read spacing data by the space adjusting means 6 (FIG. 6). Thereafter, the processing proceeds to step S9. The spacing Δh is adjusted by energizing the motor 33 to move the print head 15 toward the platen 11 until the print head 15 is held against the platen 11, thereafter reading the spacing data out of the $E^2$PROM 40, and reversing the motor 33 to move the print head 15 away from the platen 11 by an interval indicated by the spacing data read out of the $E^2$PROM 40.

Step S9 executes a carriage position correcting process for moving the carriage 14 to a home position. After step S9, the processing returns to the printing process routine.

As described above, when the lid 18 is opened during the printing process, the printing process is interrupted to make the operator safe. Until the lid 18 is closed again and the printing process is resumed, the selection of the on-line mode and the presence of a sheet are confirmed, and then the spacing is adjusted and the carriage position is corrected. If there is no sheet, then the spacing is adjusted only when a next sheet is introduced. Therefore, the spacing is adjusted only once, but not twice.

The present invention is not limited to the illustrated processing operation. While the on-line mode is selected by the operator who presses the on-line/off-line mode selector key in the above embodiment, the on-line mode may automatically be selected in response to the signal indicating the closed lid fed from the first microswitch 19. The mechanism for adjusting the spacing between the print head 15 and the platen 11 may be any of other arrangements than described and illustrated. Further, instead of setting the space adjusting flag in step S2 and checking the space adjusting flag in step S6 in the flowchart of FIG. 5, step S6 may be used to check whether an off-line flag has set or not, the off-line flag being set when the off-line mode is selected. In step S7, the print head 15 may first be returned to the home position and then moved to a desired spacing adjusting position, or the position of the print head where the printing process is interrupted may be stored and a distance required to move the print head from the stored position to the spacing adjusting position may be calculated, after which the print head may be moved the calculated distance to the spacing adjusting position, so that the distance which the print head has to move will be minimized.

As a further modification, the spacing adjusting procedure as described above may be carried out when the printer switches from the off-line mode to the on-line mode.

With the present invention, as described above, when the lid is closed after it has been opened and the printing process is to be resumed, the spacing or distance between the print head and the face of the sheet on the platen is adjusted to a desired value corresponding to the nature of the print sheet, e.g. thickness of the print sheet. Therefore, even if the spacing between the print head and the face of the sheet were varied due to physical contact to the carriage or the print head by the operator while the lid is being open, the spacing is automatically corrected and thus the quality of printed letters will not be lowered after the printing process is resumed. When the lid is opened and then closed, the operator is not required to adjust the spacing between the print head and the platen, and good and stable print quality is maintained.

Although a certain preferred embodiment has been shown and described, it should be understood that many changes and modifications may be made therein without departing from the scope of the appended claims.

What is claimed is:

1. A printer comprising:

a printer housing;

a print mechanism housed in said printer housing, said print mechanism including a print head and a platen, said print head being disposed in spaced apart relation to a sheet of print paper set on said platen and performing printing operation on the sheet of print paper set thereon, said platen being rotatably supported to said printer housing, and the sheet of print paper having a thickness;

a lid member openably attached to said printer housing for normally covering said print mechanism;

lid open/closure detecting means for detecting opening and closing of said lid member and producing a first signal when said lid member is opened in the course of the printing operation and a second signal when said lid member is closed;

sheet detecting means for detecting presence of the sheet of paper on said platen and producing a third signal when the sheet of print paper is present on said platen and a fourth signal when the sheet of print paper is absent from said platen;

distance adjusting means for adjusting a distance between the sheet of paper set on said platen and said print head; and control means for controlling said distance adjusting means so that the distance between the print paper and print head is adjusted when the second signal is produced subsequent to the production of the first signal and when the third signal has been produced when the second signal is produced.

2. A printer according to claim 1, further comprising sheet supplying means for selectively supplying different types of sheets into a gap between said print head and said platen, the different types of sheets having different sheet thicknesses, and sheet specifying means for specifying one of the different types of sheets, said sheet specifying means producing a sheet specifying signal indicative of the sheet specified.

3. A printer according to claim 2, further comprising storage means for storing data regarding the distance therebetween corresponding to the sheet thickness of each of the sheet supplied from said sheet supplying means, wherein said control means controls the distance therebetween upon reading the data out of said storing means in response to the sheet specifying signal.

4. A printer according to claim 1, wherein said distance adjusting means brings said print head into abutment against said platen and then retracts said print head away from said platen to adjust the distance therebetween.

5. A printer according to claim 1, wherein said print mechanism further includes a carriage for mounting said print head, and a pair of guide rods supported to said printer housing and disposed in parallel to said platen for supporting said carriage so that said carriage is longitudinally reciprocally movable along said pair of guide rods, and wherein said distance adjusting means comprises a pair of shafts connected to end faces of one of said pair of guide rods in offset relation, gear means operably coupled to one of said pair of shafts, a reversible motor for rotating said pair of shafts through said gear means, whereby said print head is moved toward and away from said platen by the forward and reverse rotations of said motor, respectively.

6. The printer according to claim 1, wherein said control means does not adjust the distance between the print paper and the print head when the fourth signal is produced when the second signal is produced subsequent to the production of the first signal.

7. A printer comprising:

a printer housing;

a print mechanism housed in said printer housing, said print mechanism including a print head and a platen, said print head being disposed in spaced apart relation to a sheet of print paper set on said platen and performing printing operation on the sheet of print paper set thereon, said platen being rotatably supported to said printer housing, and the sheet of print paper having a thickness;

a lid member openably attached to said printer housing for normally covering said print mechanism;

on-line/off-line mode selecting means for selecting one of on-line and off-line modes, wherein the printing operation is allowed to be carried out when the on-line mode is selected whereas the printing operation is interrupted when the off-line mode is selected;

sheet detecting means for detecting presence of the sheet of print paper on said platen and producing a first signal when the sheet of print paper is present on said platen and a second signal when the sheet of print paper is absent from said platen;

distance adjusting means for adjusting a distance between the sheet of paper set on said platen and said print head; and control means for controlling said distance adjusting means so that the distance between the print paper and the print head is adjusted when the first signal is produced under the condition where the on-line mode is selected after selection of the off-line mode.

8. A printer according to claim 7, further comprising lid open/closure detecting means for detecting opening and closing of said lid member and producing a third signal when said lid member is opened in the course of the printing operation and a fourth signal when said lid member is closed, and wherein said control means controls said distance adjusting means when the fourth signal is produced subsequent to the production of the third signal.

9. A printer according to claim 7, further comprising sheet supplying means for selectively supplying different types of sheets into a gap between said print head and said platen, the different types of sheets having different sheet thicknesses, and sheet specifying means for specifying one of the different types of sheets, said sheet specifying means producing a sheet specifying signal indicative of the sheet specified.

10. A printer according to claim 9, further comprising storage means for storing data regarding the distance therebetween corresponding to the sheet thickness of each of the sheets supplied from said sheet supplying means, wherein said control means controls the distance therebetween upon reading the data output of said storing means in response to the sheet specifying signal.

11. A printer according to claim 7, wherein said distance adjusting means brings said print head into abutment against said platen and then retracts said print head away from said platen to adjust the distance therebetween.

12. A printer according to claim 7, wherein said print mechanism further includes a carriage for mounting said printer head, and a pair of guide rods supported to said print housing and disposed in parallel to said platen for supporting said carriage so that said carriage is longitudinally reciprocally movable along said pair of guide rods, and wherein said distance adjusting means comprises a pair of shafts connected to end faces of one of said pair of guide rods in offset relation, gear means operably coupled to one of said pair of shafts, a reversible motor for rotating said pair of shafts through said gear means, whereby said print head is moved toward and away from said platen by the forward and reverse rotations of said motor, respectively.

13. The printer according to claim 7, wherein said control means does not adjust the distance between the print paper and the print head when the second signal is produced under the condition where the on-line mode is selected after selection of the off-line mode.

* * * * *